United States Patent [19]

Tseng et al.

[11] Patent Number: 5,035,573

[45] Date of Patent: Jul. 30, 1991

[54] BLADE TIP CLEARANCE CONTROL APPARATUS WITH SHROUD SEGMENT POSITION ADJUSTMENT BY UNISON RING MOVEMENT

[75] Inventors: Wu-Yang Tseng, West Chester; Ambrose A. Hauser, Wyoming, both of Ohio

[73] Assignee: General Electric Company, Cincinnati, Ohio

[21] Appl. No.: 507,428

[22] Filed: Mar. 21, 1990

[51] Int. Cl.[5] ..... F01D 11/08

[52] U.S. Cl. ..... 415/173.2; 415/126

[58] Field of Search ..... 415/173.2, 173.1, 174.1, 415/126, 127

[56] References Cited

FOREIGN PATENT DOCUMENTS 26211 2/1982 Japan ..... 415/173.2

*Primary Examiner*—John T. Kwon

*Attorney, Agent, or Firm*—Jerome C. Squillaro

[57] ABSTRACT

A clearnace control apparatus has a plurality of positioning mechanisms and an annular unison ring for controlling the clearance between the rotor blade tips and shroud segments of a gas turbine engine casing. The positioning mechanisms are supported by circumferentially-spaced casing bosses, connected to the shroud, and actuatable by the unison ring for moving radially toward and away from the rotor blade tips. As the positioning mechanisms are moved radially, the shroud segments move therewith toward and away from the rotor axis to positioned between inner and outer positions which define minimum and maximum clearances between the shroud segments and rotor blade tips. The unison ring has circumferentially spaced slots defined therethrough each extending in a transverse inclined relation to the respective directions of movement of the unison ring and positioning mechanisms and having spaced opposite ends defining first and second angularly displaced limit positions of the unison ring. The positioning mechanisms are coupled to the unison ring by pins which extend through the respective inclined slots.

12 Claims, 3 Drawing Sheets

BLADE TIP CLEARANCE CONTROL APPARATUS WITH SHROUD SEGMENT POSITION ADJUSTMENT BY UNISON RING MOVEMENT

RIGHTS OF THE GOVERNMENT

The United States Government has rights in this invention pursuant to Contract No. F33615-87-C-2764 awarded by the Department of Air Force.

CROSS-REFERENCE TO RELATED APPLICATIONS

Reference is hereby made to the following copending U. S. Pat. Applications dealing with related subject matter and assigned to the assignee of the present invention:

1. "Blade Tip Clearance Control Apparatus For A Gas Turbine Engine" by John J. Ciokajlo, assigned U. S. Serial No. 07/405,369, and filed Sept. 8, 1989.
2. "Mechanical Blade Tip Clearance Control Apparatus For A Gas Turbine Engine" by John J. Ciokajlo et al, assigned U. S. Serial No. 07/404,923 and filed Sept. 8, 1989.
3. "Blade Tip Clearance Control Apparatus Using Bellcrank Mechanism" by Robert J. Corsmeier et al, assigned U. S. Ser. No. 07/440,633 and filed Nov. 22, 1989.
4. "Blade Tip Clearance Control Apparatus Using Cam-Actuated Shroud Segment Positioning Mechanism" by Robert J. Corsmeier et al, assigned U. S. Ser. No. 07/482,139 and filed Feb. 20, 1990.
5. "Blade Tip Clearance Control Apparatus Using Shroud Segment Position Modulation" by Robert J. Corsmeier et al, assigned U. S. Ser. No. 07/480,198 and filed Feb. 12, 1990.

BACKGROUND OF THE INVENTION b 1. Field of the Invention

The present invention relates generally to gas turbine engines and, more particularly, to an apparatus for controlling clearance between adjacent rotating and non-rotating components of a gas turbine engine.

2. Description of the Prior Art

The efficiency of a gas turbine engine is dependent upon many factors, one of which is the radial clearance between adjacent rotating and non-rotating components, such as, the rotor blade tips and the casing shroud surrounding the outer tips of the rotor blades. If the clearance is too large, an unacceptable degree of gas leakage will occur with a resultant loss in efficiency. If the clearance is too small, there is a risk that under certain conditions contact will occur between the rotating and stator components with detrimental damage possibly occurring.

The potential for contact occurring is particularly acute when the engine rotational speed is changing, either increasing or decreasing, since temperature differentials across the engine frequently result in the rotating and non-rotating components radially expanding and contracting at different rates. For instance, upon engine accelerations, thermal growth of the rotor typically lags behind that of the casing. During steadystate operation, the growth of the casing ordinarily matches more closely that of the rotor. Upon engine decelerations, the casing contracts more rapidly than the rotor.

Control mechanisms, usually mechanically or thermally actuated, have been proposed in the prior art to maintain blade tip clearance substantially constant.

However, none are believed to represent the optimum design for controlling clearance. Thus, a need still remains for an improved mechanism for clearance control that will improve engine performance and reduce fuel consumption.

SUMMARY OF THE INVENTION

The present invention provides a blade tip clearance control apparatus which satisfies the aforementioned needs and achieves the foregoing objectives. The blade tip clearance control apparatus employs a shroud segment positioning mechanism having components which achieve these objectives without a large increase in weight. The positioning mechanism is operable to maintain minimum rotor blade tip-shroud clearance during steady state operation. Also, the positioning mechanism is capable of adjusting quickly as an operating transient occurs for preventing excessive rubs during any transient operation of the engine, thereby improving engine performance. Further, the components of the positioning mechanism are located outside the casing for easy maintenance, and are few in number and easy to manufacture and assemble.

Accordingly, the clearance control apparatus of the present invention is provided in a gas turbine engine which includes a rotatable rotor having a central axis and a row of blades with tips and a stationary casing, with a shroud, disposed in concentric relation with the rotor. The clearance control apparatus, operable for controlling the clearance between the rotor blade tips and the casing shroud, comprises: (a) at least one shroud segment defining a circumferential portion of the casing shroud and being separate from and spaced radially inwardly of the casing and outwardly of at least one of the rotor blade tips; (b) at least one mounting structure on the stationary casing defining a passage between exterior and interior sides of the casing, the mounting structure being spaced radially outwardly from the shroud segment; (c) a positioning mechanism supported by the mounting structure, connected to the shroud segment, and being movable toward and away from the rotor axis for moving the shroud segment toward and away from the rotor blade tip; and (d) an actuating mechanism coupled to the positioning mechanism and being operable to move circumferentially relative to the rotor axis between first and second angularly displaced limit positions to cause nonrotatable, linear movement of the positioning mechanism and the shroud segment connected thereto radially relative to the rotor axis to a position between inner and outer positions which define maximum and minimum clearances between the shroud segment and rotor blade tip.

More particularly, the positioning mechanism includes an elongated support member mounted through the passage defined by the mounting structure for movement relative thereto and radially toward and away from the rotor axis. The support member has a longitudinal axis and opposite inner and outer end portions. The shroud segment is connected to the inner end portion of the support member at the interior side of the casing. The positioning mechanism also includes means for coupling the outer end portion of the support member at the exterior side of the casing to the actuating mechanism.

Further, the mounting structure is a cylindrical boss formed on the casing, defining the passage, and projecting from the exterior side of the casing. The support member is a cylindrical shaft mounted through the passage of the boss for slidable movement toward and away from the rotor axis relative to the boss. The actuating mechanism is an annular member having at least one slot extending in a transverse inclined relation to the respective directions of movement of the actuating mechanism and the shaft and having spaced opposite ends defining the first and second angularly displaced limit positions of circumferential movement of the annular member. The coupling means of the positioning mechanism is a pin mounted to the outer end of the shaft and within the slot for translating circumferential movement of the annular member into linear radial movement of the shaft.

These and other features and advantages and attainments of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the course of the following detailed description, reference will be made to the attached drawings in which.

DETAILED DESCRIPTION OF THE INVENTION

Figure 1:
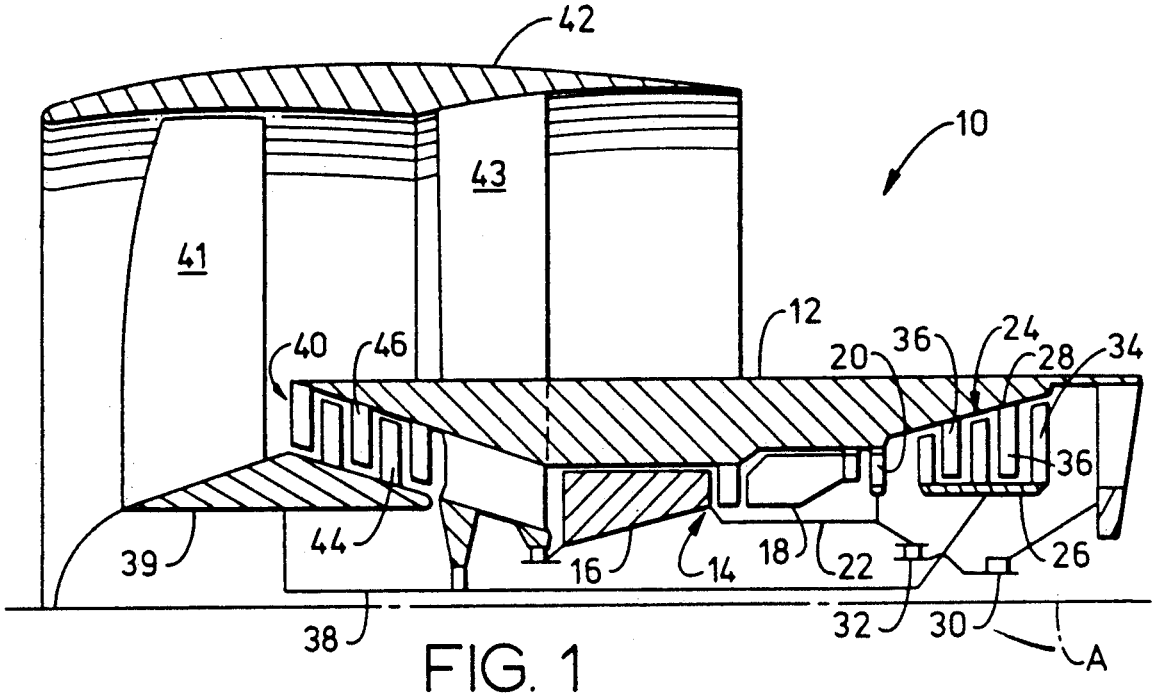
FIG. 1 is a schematic view of a gas turbine engine.

In the following description, like reference characters designate like or corresponding parts throughout the several views. Also in the following description, it is to be understood that such terms as "forward", "rearward", "left", "right", "upwardly", "downwardly", and the like, are words of convenience and are not to be construed as limiting terms.

In General

Referring now to the drawings, and particularly to FIG. 1 there is illustrated a gas turbine engine, generally designated 10, to which the present invention can be applied. The engine 10 has a longitudinal center line or axis A and an annular casing 12 disposed coaxially and concentrically about the axis A. The engine 10 includes a core gas generator engine 14 which is composed of a compressor 16, a combustor 18, and a high pressure turbine 20, either single or multiple stage, all arranged coaxially about the longitudinal axis or center line A of the engine 10 in a serial, axial flow relationship. An annular drive shaft 22 fixedly interconnects the compressor 16 and high pressure turbine 20.

The core engine 14 is effective for generating combustion gases. Pressurized air from the compressor 16 is mixed with fuel in the combustor 18 and ignited, thereby generating combustion gases. Some work is extracted from these gases by the high pressure turbine 20 which drives the compressor 16. The remainder of the combustion gases are discharged from the core engine 14 into a low pressure power turbine 24.

The low pressure turbine 24 includes an annular drum rotor 26 and a stator 28. The rotor 26 is rotatably mounted by suitable bearings 30 and includes a plurality of turbine blade rows 34 extending radially outwardly therefrom and axially spaced. The stator 28 is disposed radially outwardly of the rotor 26 and has a plurality of stator vane rows 36 fixedly attached to and extending radially inwardly from the stationary casing 12. The stator vane rows 36 are axially spaced so as to alternate with the turbine blade rows 34. The rotor 26 is fixedly attached to drive shaft 38 and interconnected to drive shaft 22 via differential bearings 32. The drive shaft 38, in turn, rotatably drives a forward booster rotor 39 which forms part of a booster compressor 40 and which also supports forward fan blade rows 41 that are housed within a nacelle 42 supported about the stationary casing 12 by a plurality of struts 43, only one of which is shown. The booster compressor 40 is comprised of a plurality of booster blade rows 44 fixedly attached to and extending radially outwardly from the booster rotor 39 for rotation therewith and a plurality of booster stator vane rows 46 fixedly attached to and extending radially inwardly from the stationary casing 12. Both the booster blade rows 44 and the stator vane rows 46 are axially spaced and so arranged to alternate with one another.

Clearance Control Apparatus of the Prior Art

Figure 2:
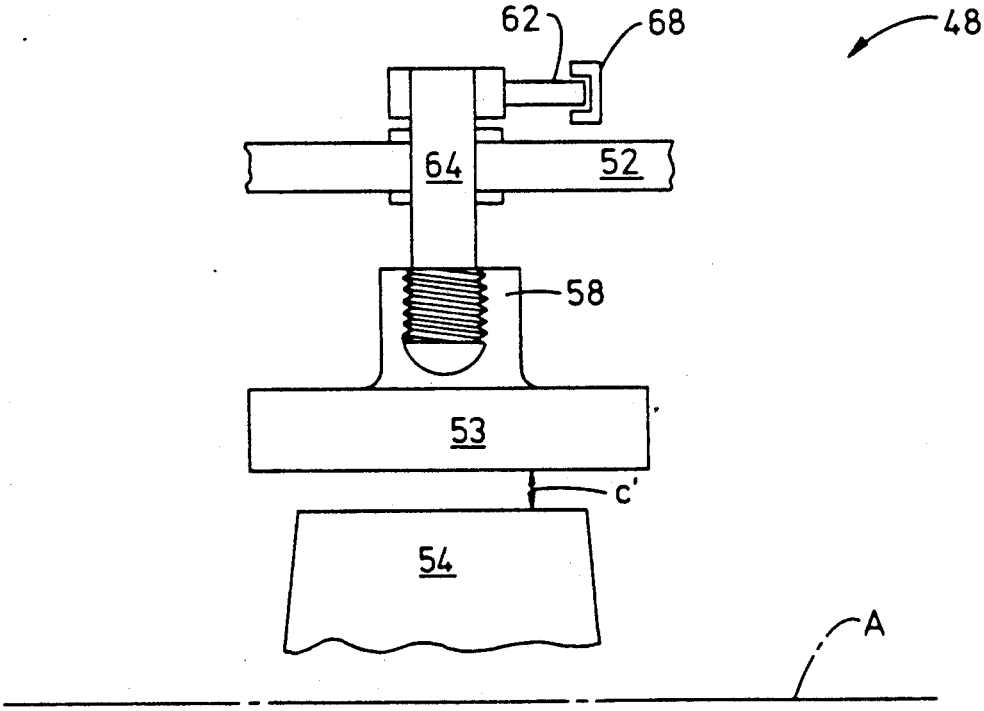
FIG. 2 (PRIOR ART)
FIG. 2 is a longitudinal axial sectional view of one prior art mechanical apparatus for controlling rotor blade tip and stator casing shroud clearance.
Figure 3:
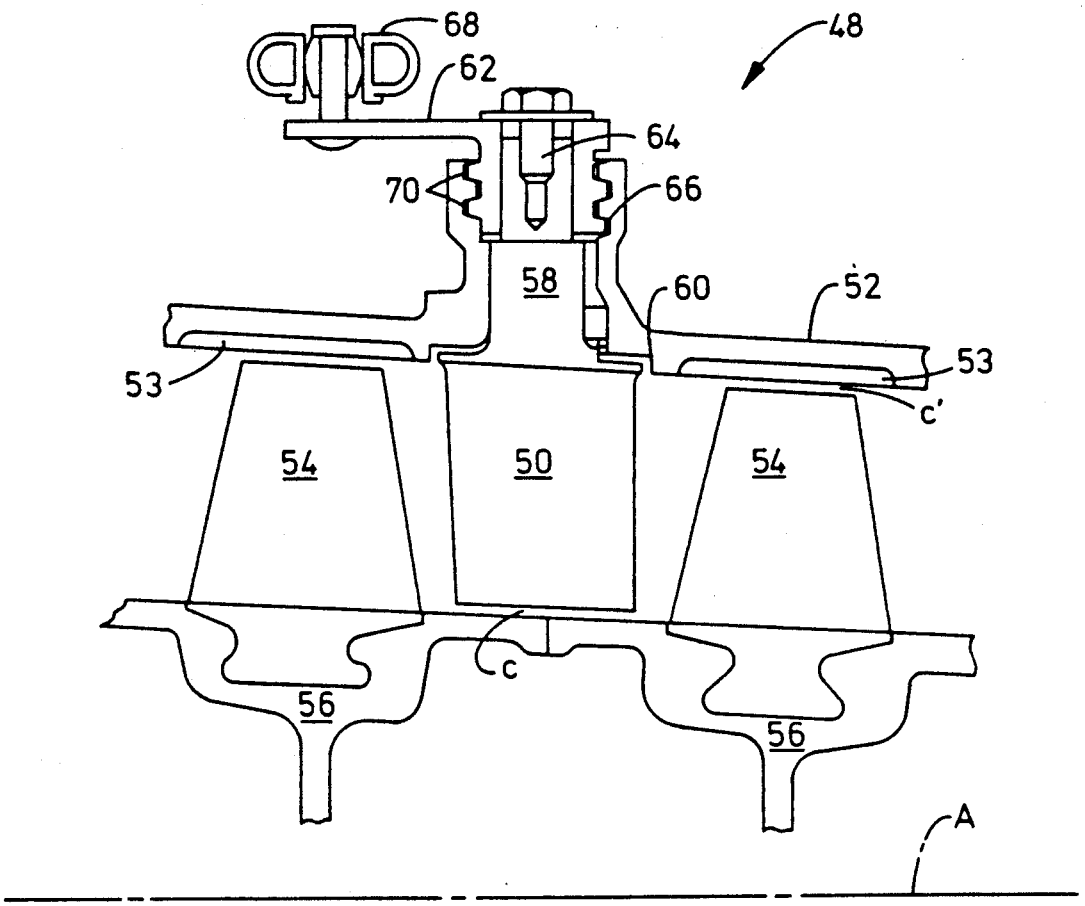
FIG. 3 (PRIOR ART)
FIG. 3 is a longitudinal axial sectional view of another prior art mechanical apparatus for controlling rotor and stator vane tip clearance.
Figure 4:
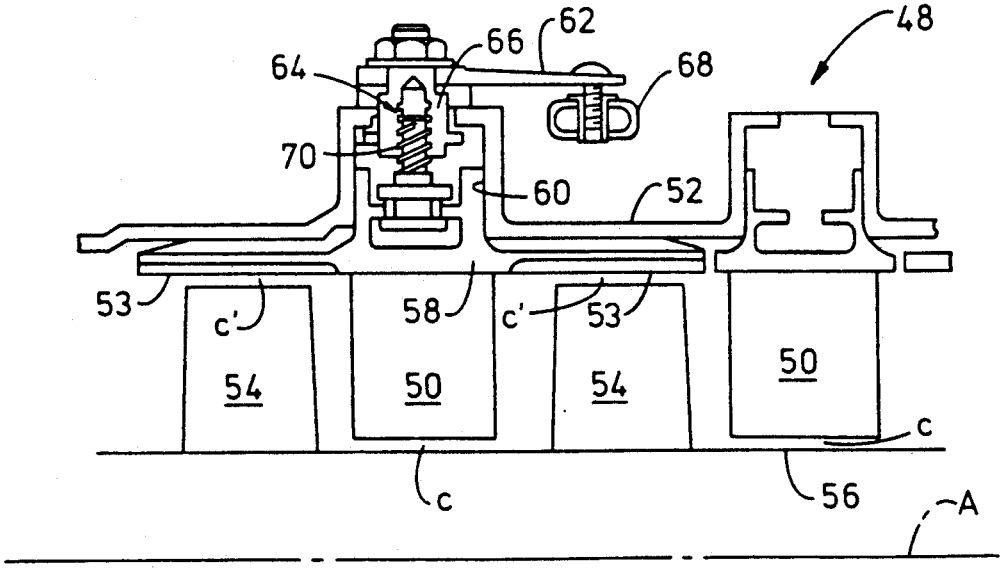
FIG. 4 (PRIOR ART)
FIG. 4 is a longitudinal axial sectional view of yet another prior art mechanical apparatus for controlling rotor blade tip and stator casing shroud clearance and rotor and stator vane tip clearance.

Referring now to FIGS. 2, 3 and 4, there is illustrated three variations of a prior art clearance control apparatus, generally designated 48 (disclosed on pages 8 and 15 of a publication entitled "Thermal Response Turbine Shroud Study" by E. J. Kawecki, dated July 1979, Technical Report AFAPL-TR-79-2087). The clearance control apparatus 48 is operable for changing the tip clearance gap C between the stator vanes 50, coupled on a stationary casing 52, and a rotatable rotor 56; and/or, the tip clearance gap C' between the rotatable rotor blades 54 and the casing shroud 53 of a gas turbine engine, such as the engine 10 just described.

In the FIG. 2 embodiment, the shroud segment 53 is separate from the casing 52 and is mounted on the end of a screw 64 for radial movement relative to the casing 52 toward and away from the tip of the rotor blade 54 for adjustment of the clearance gap C' therebetween. In the FIGS. 3 and 4 embodiments, the stator vanes 50 are mounted on shanks 58 which, in turn, are disposed in openings 60 in the casing 52 for radial movement toward and away from the rotor 56. Each shank is coupled to a lever arm 62 by the screw 64 threaded into a fitting 66 attached to the casing 52. Also, a unison ring 68 upon circumferential movement rotates the screw 64 via the lever arm 62 in order to adjust the clearance gap. To reduce the effects of thermal expansion on the clearance control apparatus 48, each screw 64 has threads 70 of a square cross section. In each of these embodiments, the shroud segment 53 is attached to the stationary casing 52 with the shroud segment 53 being fixedly attached in the FIG. 3 embodiment and movably attached in the FIG. 4 embodiment.

It should be noted that in the FIG. 3 embodiment, the clearance control apparatus 48 operates to adjust the clearance gap C between the tip of the stator vane 50 and the rotor 56, but does not adjust the clearance gap C'between the tip of the rotor blade 54 and the shroud segment 53. However, in the FIG. 4 embodiment, operation of the clearance control apparatus 48 not only adjusts the clearance gap C between the tip of the stator vane 50 and the rotor 56, but also, simultaneously therewith, adjusts the clearance gap C' between the tip of the rotor blade 54 and the shroud segment 53.

Clearance Control Apoaratus of Present Invention

Figure 5:
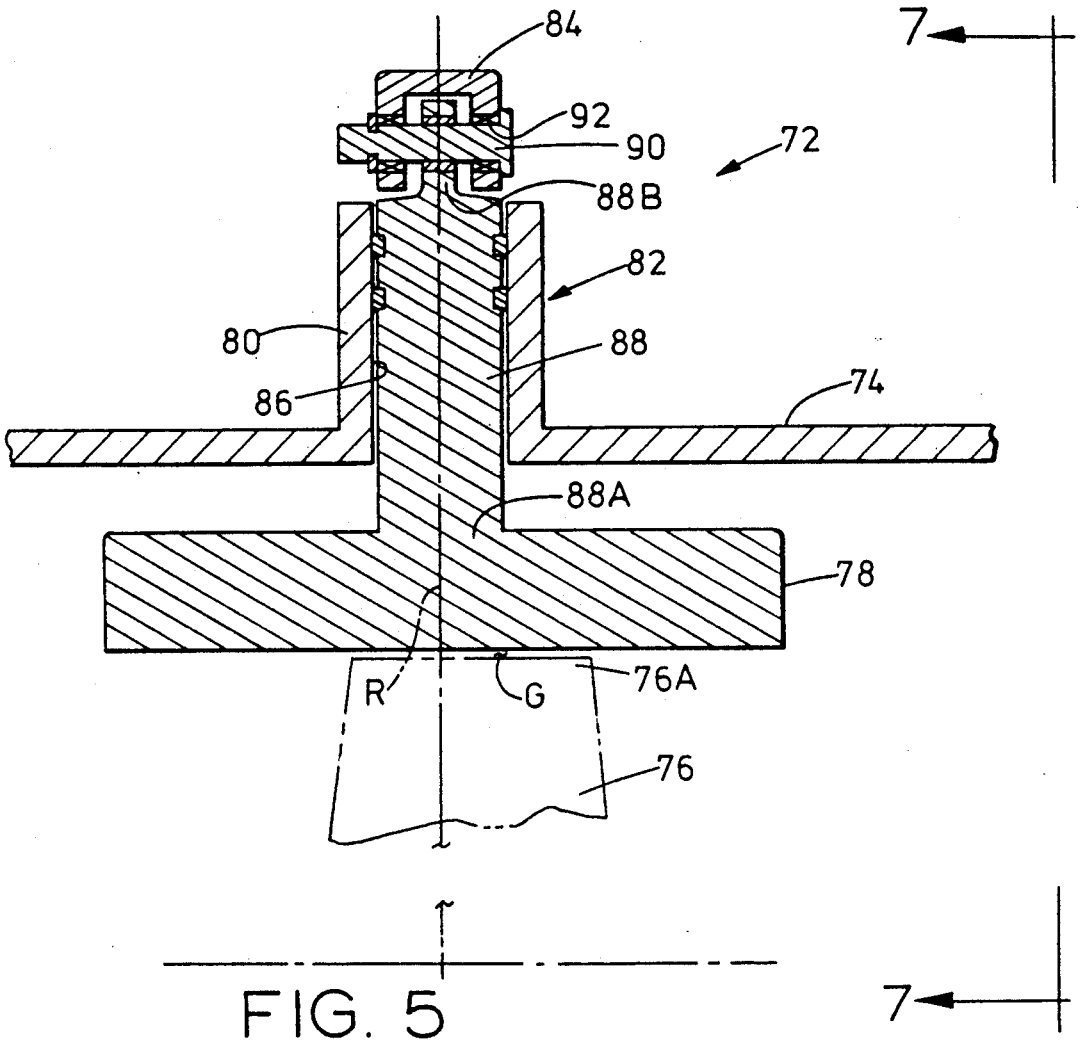
FIG. 5 is an enlarged fragmentary longitudinal axial sectional view of a blade tip clearance control apparatus in accordance with the present invention.
Figure 6:
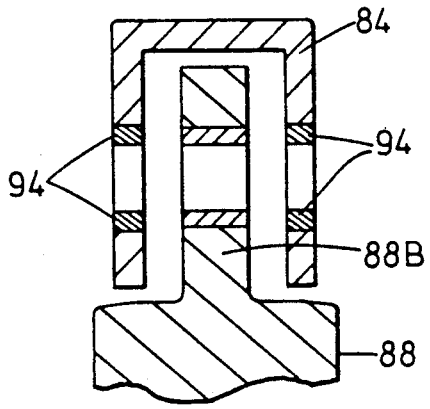
FIG. 6 is an enlarged fragmentary view of the apparatus of FIG. 5 with a roller pin of the apparatus removed.
Figure 7:
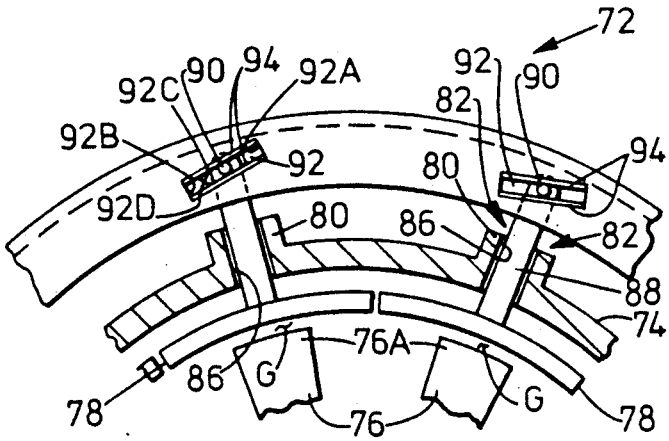
FIG. 7 is a reduced fragmentary circumferential sectional view of the apparatus as seen along line 7—7 of FIG. 5.

Turning now to FIGS. 5–7, there is illustrated a mechanical clearance control apparatus, generally designated 72, in accordance with the present invention. This apparatus 72 can advantageously be used with all compressor and turbine rotors of a gas turbine engine, such as the engine 10 illustrated in FIG. 1, where the rotors have smooth shrouded outer flowpaths and where rotor blade tip to shroud operating minimum clearances are required over the operating range of the engine. Also, the clearance control apparatus 72 is applicable to either aircraft or land based gas turbine engines.

The clearance control apparatus 72 is operable for controlling the gap or clearance G between a stationary casing 74 and outer tips 76A of a plurality of blades 76 of a rotor (not shown) which extend radially outwardly in alternating fashion between stator vanes (not shown) which, in turn, are stationarily attached to and extending radially inwardly from the casing 74. More particularly, the clearance control apparatus 72 is operable to mechanically modulate the radial positions of a plurality of shroud segments 78 making up the casing shroud to control the clearance G the entire 360 degrees around the rotor blade tips 76A and the stationary casing 74.

The clearance control apparatus 72 includes a plurality of shroud segments 78 (see FIG. 7), each having an elongated arcuate-shaped body. The shroud segments 78 define successive circumferential portions of a casing shroud and are separate from and spaced radially inwardly of the casing 74. In addition to the shroud segments 78, the clearance control apparatus 72 includes a plurality of mounting structures in the form of cylindrical bosses 80 formed on the casing 74, a plurality of positioning mechanisms 82, and an actuating mechanism 84 operable for actuating the positioning mechanisms 82. The mounting bosses 80 are circumferentially spaced from one another around the rotor axis A and are integral with the casing 74. The bosses 80 define respective passages 86 extending between the outer, or exterior, side and the inner, or interior, side of the casing 74 and are spaced radially outwardly from the shroud segments 78, and project outwardly from the exterior side of the casing.

The positioning mechanisms 82 of the apparatus 72 are supported by the respective stationary casing bosses 80 and rigidly connected to the respective shroud segments 78. The positioning mechanisms 82 are actuatable concurrently by the actuating mechanism 84 for moving toward and away from the rotor axis A and thereby for moving the shroud segments 78 connected therewith toward and away from the rotor blade tips 76A. In particular, each positioning mechanism 82 includes an elongated support member in the form of an elongated cylindrical shaft 88 mounted through the passage 86 defined by one of the bosses 80 for movement relative thereto and radially toward and away from the rotor axis A. The cylindrical support shaft 88 having a longitudinal axis R which extends perpendicular to the rotor axis A and opposite inner and outer end portions 88A, 88B. Each shroud segment 78 is rigidly connected to the inner end portion 88A of one support shaft 88 at the interior side of the casing 74. Each positioning mechanism 82 also includes means in the form of a cylindrical pin 90 for coupling the outer end portion 88B of one support shaft 88 at the exterior side of the casing 74 to the actuating mechanism 84.

The actuating means 84 of the apparatus 72 is coupled to the positioning mechanisms 82 and operable to move circumferentially relative to the rotor axis A between first and second angular displaced limit positions to cause nonrotatable, linear movement of the cylindrical shafts 88. Such linear movement of the shafts 88, in turn, causes movement of the shroud segments 78 connected therewith radially relative to the rotor axis A to positions between the inner and outer limit positions which define maximum and minimum clearances between the shroud segments 78 and the rotor blade tips 76A. More particularly, the actuating mechanism 84 is an annular member in the form an unison ring. The unison ring 84 has a plurality of circumferentially spaced slots 92 defined therethrough each extending in a transverse inclined relation to the respective directions of movement of the support shafts 88 and the unison ring 84. The slots 92 have spaced opposite ends 92A, 92B which define the first and second angularly displaced limit positions between which the unison ring 84 can move circumferentially.

The pins 90 which couple the support shafts 88 with the unison ring 84 are engaged and moved by one or the other of the opposite sides 92C, 92D of the slots 92 when the unison ring 84 is moved in one or the other of the circumferential directions. Movement of the pins 90 along the slots 92 results in the translation of the circumferential movement of the unison ring 84 into linear radial movement of the shaft 88 and the one shroud segment 78. A bearing 94, such as a needle or roller bearing, is disposed between the pin 90 and one of the support shaft outer end portion member 88B or the unison ring 84 for providing rolling contact therebetween.

In summary, the positioning mechanisms 82 of the apparatus 72 are mechanically coupled to the unison ring 84 such that upon clockwise or counterclockwise rotation of the ring 84 in the circumferential direction the positioning mechanisms 82 will radially move the shroud segments 78 therewith toward or away from the rotor blade tips 76A to any location between outer and inner positions relative to the rotor (not shown) which correspond to maximum and minimum clearances between the shroud segments 78 and the rotor blade tips 76A. Further, upon termination of movement of the unison ring 84, the mechanisms 82 will hold the shroud segments 78 at such location to maintain the desired clearance between the shroud segments and the rotor blade tips. A conventional modulation control system (not shown) having clearance and engine maneuver loading sensors can be used for circumferentially rotating the unison ring 84. Since the control system and the components associated therewith form no part of the present invention, a detailed discussion of them is not necessary for understanding the clearance control apparatus 10 of the present invention.

It is thought that the present invention and many of its attendant advantages will be understood from the foregoing description and it will be apparent that various changes may be made in the form, construction and arrangement of the parts thereof without departing from the spirit and scope of the invention or sacrificing all of its material advantages, the forms hereinbefore described being merely preferred or exemplary embodiments thereof.

We claim:

1. In a gas turbine engine including a rotatable rotor having a central axis and a row of blades with outer tips and a stationary casing with a shroud disposed in concentric relation with said rotor, an apparatus for controlling the clearance between said rotor blade tips and casing shroud, said apparatus comprising:

(a) at least one shroud segment defining a circumferential portion of said casing shroud and being separate from and spaced radially inwardly of said casing and outwardly of at least one of said rotor blade tips;

(b) at least one mounting structure on said stationary casing defining a passage between exterior and interior sides of said casing, said mounting structure being spaced radially outwardly from said shroud segment;

(c) a positioning mechanism supported by said mounting structure, connected to said shroud segment, and being movable toward and away from said rotor blade tip; and (d) an actuating mechanism coupled to said positioning mechanism and being operable to move circumferentially relative to said rotor axis between first and second angularly displaced limit positions to cause nonrotatable, linear movement of said positioning mechanism and said shroud segment connected therewith radially relative to said rotor axis to a position between inner and outer positions which define maximum and minimum clearance between said shroud segment and said rotor blade tip;

said actuating mechanism being in the form of an annular member having at least one slot defined therethrough extending in a transverse inclined relation to the respective directions of movement of said actuating and positioning mechanisms and having spaced opposite ends defining said first and second angularly displaced limit positions of said annular member at said slot therethrough.

2. The apparatus as recited in claim 1, wherein said positioning mechanism includes:

an elongated support member mounted through said passage defined by said mounting structure for movement relative thereto and radially toward and away from said rotor axis, said support member having a longitudinal axis and opposite inner and outer end portions, said shroud segment being connected to said inner end portion of said support member at said interior side of said casing; and means for coupling said outer end portion of said support member at said exterior side of said casing to said actuating mechanism.

3. The apparatus as recited in claim 2, wherein:

said mounting structure is a cylindrical boss formed on said casing, defining said passage, and projecting from said exterior side of said casing; and said support member is a cylindrical shaft mounted through said passage of said boss for slidable movement toward and away from said rotor axis relative to said boss.

4. In a gas turbine engine including a rotatable rotor having a central axis and a row of blades with outer tips and a stationary casing with a shroud disposed in concentric relation with said rotor, an apparatus for controlling the clearance between said rotor blade tips and casing shroud, said apparatus comprising:

(a) at least one shroud segment defining a circumferential portion of said casing shroud and being separate from and spaced radially inwardly of said casing and outwardly of at least one of said rotor blade tips;

(b) at least one mounting structure on said stationary casing defining a passage between exterior and interior sides of said casing, said mounting structure being spaced radially outwardly from said shroud segment;

(c) a positioning mechanism supported by said mounting structure, connected to said shroud segment, and being movable toward and away from said rotor blade tip; and (d) an actuating mechanism coupled to said positioning mechanism and being operable to move circumferentially relative to said rotor axis between first and second angularly displaced limit positions to cause nonrotatable, linear movement of said positioning mechanism and said shroud segment connected therewith radially relative to said rotor axis to a position between inner and outer positions which define maximum and minimum clearance between said shroud segment and said rotor blade tips, said actuating mechanism being in the form of an annular member having at least one slot extending in a transverse inclined relation to the respective directions of movement of said actuating and positioning mechanisms and having spaced opposite ends defining said first and second angularly displaced limit positions of circumferential movement of said annular member, said positioning mechanism being coupled to said annular member at said slot therein;

said positioning mechanism including (i) an elongated support member mounted through said passage defined by said mounting structure for movement relative thereto and radially toward and away from said rotor axis, said support member having a longitudinal axis and opposite inner and outer end portions, said shroud segment being connected to said inner end portion of said support member at said interior side of said casing, and (ii) means for coupling said outer end portion of said support member at said exterior side of said casing to said actuating mechanism.

5. In a gas turbine engine including a rotatable rotor having a central axis and a row of blades with outer tips and a stationary casing with a shroud disposed in concentric relation with said rotor, an apparatus for controlling the clearance between said rotor blade tips and casing shroud, said apparatus comprising:

(a) at least one shroud segment defining a circumferential portion of said casing shroud and being separate from and spaced radially inwardly of said casing and outwardly of at least one of said rotor blade tips;

(b) at least one mounting structure on said stationary casing defining a passage between exterior and interior sides of said casing, said mounting structure being spaced radially outwardly from said shroud segment;

(c) a positioning mechanism supported by said mounting structure, connected to said shroud segment, and being movable toward and away from said rotor blade tip; and (d) an actuating mechanism coupled to said positioning mechanism and being operable to move circumferentially relative to said rotor axis between first and second angularly displaced limit positions to cause nonrotatable, linear movement of said positioning mechanism and said shroud segment connected therewith radially relative to said rotor axis to a position between inner and outer positions which define maximum and minimum clearance between said shroud segment and said rotor blade tip;

said positioning mechanism including (i) an elongated support member mounted through said passage defined by said mounting structure for movement relative thereto and radially toward and away from said rotor axis, said support member having a longitudinal axis and opposite inner and outer end portions, said shroud segment being connected to said inner end portion of said support member at said interior side of said casing, and (ii) means for coupling said outer end portion of said support member at said exterior side of said casing to said actuating mechanism, said coupling means including a pin mounted to said outer end of said support member and within said slot of said annular member for translating circumferential movement of said annular member into linear radial movement of said support member.

6. The apparatus as recited in claim 5, wherein said coupling means further includes a roller bearing disposed between said pin and one of said support member or said annular member for providing rolling contact therebetween.

7. In a gas turbine engine including a rotatable rotor having a central axis and a row of blades with outer tips and a stationary casing with a shroud disposed in concentric relation with said rotor, an apparatus for controlling the clearance between said rotor blade tips and casing shroud, said apparatus comprising:

(a) a plurality of shroud segments defining circumferential portions of said casing shroud and being separate from and spaced radially inwardly of said casing and outwardly from said rotor blade tips;

(b) a plurality of mounting structures on said stationary casing defining passages between exterior and interior sides of said casing, said mounting structures being circumferentially spaced from one another about said rotor axis and spaced radially outwardly from said shroud segments;

(c) a plurality of positioning mechanisms supported by said mounting structures, rigidly connected to said shroud segments, and being movable toward and away from said rotor axis for moving said shroud segments toward and away from said rotor blade tips; and (d) an actuating mechanism coupled to said positioning mechanisms and being operable to move circumferentially relative to said rotor axis between first and second angularly displaced limit positions to cause nonrotatable, linear movement of said positioning mechanisms and said shroud segments connected therewith radially relative to said rotor axis to positions between inner and outer positions which define maximum and minimum clearances between said shroud segments and said rotor blade tips;

said actuating mechanism being in the form of an annular member having a plurality of circumferentially spaced slots defined therethrough each extending in a transverse inclined relation to the respective directions of movement of said actuating and positioning mechanisms and having spaced opposite ends defining said first and second angularly displaced limit positions of said annular member, said positioning mechanisms being coupled to said annular member at said slots therethrough.

8. The apparatus as recited in claim 7, wherein each of said positioning mechanisms includes:

an elongated suport member mounted through said passage defined by one of said mounting structures for movement relative thereto and radially toward and away from said rotor axis, said support member having a longitudinal axis and opposite inner and outer end portions, one of said shroud segments being rigidly connected to said inner end portion of said support member at said interior side of said casing; and means for coupling said outer end portion of said support member at said exterior side of said casing to said actuating mechanism.

9. The apparatus as recited in claim 8, wherein:

each of said mounting structures is a cylindrical boss formed on said casing, defining said passage, and projecting from said exterior side of said casing; and each of said support members is a cylindrical shaft mounted through said passage of one of said bosses for slidable movement toward and away from said rotor axis relative to said boss.

10. In a gas turbine engine including a rotatable rotor having a central axis and a row of blades with outer tips and a stationary casing with a shroud disposed in concentric relation with said rotor, an apparatus for controlling the clearance between said rotor blade tips and casing shroud, said apparatus comprising:

(a) a plurality of shroud segments defining circumferential portions of said casing shroud and being separate from and spaced radially inwardly of said casing and outwardly from said rotor blade tips;

(b) a plurality of mounting structures on said stationary casing defining passages between exterior and interior sides of said casing, said mounting structures being circumferentially spaced from one another about said rotor axis and spaced radially outwardly from said shroud segments;

(c) a plurality of positioning mechanisms supported by said mounting structures, rigidly connected to said shroud segments, and being movable toward and away from said rotor axis for moving said shroud segments toward and away from said rotor blade tips; and (d) an actuating mechanism coupled to said positioning mechanisms and being operable to move circumferentially relative to said rotor axis between first and second angularly displaced limit positions to cause nonrotatable, linear movement of said positioning mechanisms and said shroud segments connected therewith radially relative to said rotor axis to positions between inner and outer positions which define maximum and minimum clearances between said shroud segments and said rotor blade tips, said actuating mechanism being in the form of an annular member having a plurality of circumferentially spaced slots defined therethrough each extending in a transverse inclined relation to the respective directions of movement of said actuating and positioning mechanisms and having spaced opposite ends defining said first and second angularly displaced limit positions of said annular member, said positioning mechanisms being coupled to said annular member at said slots therethrough;

each of said positioning mechanisms including (i) an elongated support member mounted through said passage defined by one of said mounting structures for movement relative thereto and radially toward and away from said rotor axis, said support member having a longitudinal axis and opposite inner and outer end portions, one of said shroud segments being rigidly connected to said inner end portion of said support member at said interior side of said casing; and (ii) means for coupling said outer end portion of said support member at said exterior side of said casing to said actuating mechanism.

11. The apparatus as recited in claim 10, wherein said means for coupling each of said support members to said actuating mechanism includes a pin mounted to said outer end of said support member and within one of said slots of said annular member for translating circumferential movement of said annular member into linear radial movement of said support members.

12. The apparatus as recited in claim 11, wherein said coupling means further includes a roller bearing disposed between said pin and one of said support member or said annular member for providing rolling contact therebetween.

* * * * *